United States Patent [19]

Husted

[11] Patent Number: 4,889,034

[45] Date of Patent: Dec. 26, 1989

[54] AUTOMATIC RECIPROCATOR WITH MANIFOLD AND SLEEVE VALVE

[76] Inventor: Royce H. Husted, 711 Lakeside Dr., Wheaton, Ill. 60187

[21] Appl. No.: 212,894

[22] Filed: Jun. 29, 1988

[51] Int. Cl.[4] ..... F01L 15/00

[52] U.S. Cl. ..... 91/218; 91/277; 91/330; 91/410; 91/466

[58] Field of Search ..... 91/277, 327, 328, 330, 91/471, 218, 232, 247, 276, 331, 344, 346, 350, 303, 410, 466; 137/625.25; 251/343

[56] References Cited

U.S. PATENT DOCUMENTS

| | | | |
|---|---|---|---|
| 881,048 | 3/1908 | Betts | 91/330 X |
| 2,377,595 | 6/1945 | Wiles | 251/343 X |
| 2,421,194 | 5/1947 | Given, Jr. | 91/218 X |
| 3,853,036 | 12/1974 | Eskridge et al. | 91/276 |
| 4,128,209 | 12/1978 | Johnson | 251/343 X |

FOREIGN PATENT DOCUMENTS

| | | | |
|---|---|---|---|
| 2629564 | 1/1978 | Fed. Rep. of Germany | 91/277 |
| 1096337 | 12/1967 | United Kingdom | 251/343 |

*Primary Examiner*—Edward K. Look
*Assistant Examiner*—Mark A. Williamson
*Attorney, Agent, or Firm*—Nicholas A. Camasto

[57] ABSTRACT

A pneumatic reciprocator includes a cylindrical air cylinder concentrically mounted within a cylindrical manifold. A cylindrical sleeve valve is concentrically mounted for movement along the manifold by a pair of spaced O rings. Two sets of circumferentially arranged air holes in the manifold are alternately covered and uncovered by the O rings as the sleeve valve is moved to selectively pressurize and vent opposite sides of the piston in the air cylinder. Movement of the sleeve valve is controlled by stops on the movable bed of a surface grinder that is controlled by the air cylinder.

11 Claims, 3 Drawing Sheets

AUTOMATIC RECIPROCATOR WITH MANIFOLD AND SLEEVE VALVE

BACKGROUND OF THE INVENTION AND PRIOR ART

This invention relates in general to pneumatic reciprocators for automatically reciprocating, i.e. moving an object back and forth, and specifically to pneumatic reciprocators for use with machine tools such as surface grinders.

Professional type surface grinders are tools in which a grinding wheel is held stationary with respect to a movable workpiece for performing precise machining operations on the workpiece. To secure the workpiece to the movable table of the surface grinder, a magnetic chuck mechanism is conventionally used. The surface grinder table is controllable by a machinist to perform precision work in three dimensions; length, width and depth. A surface grinder is used to produce very fine finished surfaces and therefore the movable table must provide stability and precision movement. It is thus quite massive. Crank wheels are used by the machinist to move the table horizontally in and out, in addition to an adjustment device for moving the grinding wheel vertically. During a finishing operation, moving the table horizontally back and forth requires a great deal of physical effort by the machinist. While certain surface grinders include mechanisms for automatically reciprocating (i.e. moving the table back and forth), the mechanisms are complex and quite expensive. Indeed, the cost of a surface grinder with an automatically reciprocating table is about double the cost of a surface grinder without that feature.

With the invention, a very simple, low cost attachment is provided for automatically reciprocating the movable table on a surface grinder. The distance or stroke of the table is determined by the machinist. The inventive device is pneumatically operated, requires no electrical connections, and is readily mounted on a standard surface grinder. With the invention, the very tiring cranking required of the machinist is totally eliminated.

The automatic reciprocator of the invention utilizes a novel combination of elements that include a standard off-the-shelf air cylinder assembly that is modified slightly and fitted within a cylindrical manifold, over which a sleeve valve is movably mounted. The reciprocator assembly is affixed to the base of the surface grinder and the piston rod of the air cylinder is connected to the movable table. A pair of adjustable stops carried by the table control the stroke or travel distance of the table by displacing the movable sleeve valve on the manifold to open and close sets of cylindrically arranged air holes in the manifold for reversing the direction of piston movement.

A feature of the invention is the relative spacing of the resilient seals carried by the sleeve valve relative to the sets of air holes which cooperate to provide pneumatic cushioning of the massive table. Another feature is the vented dust boots sealing the movable sleeve valve to the manifold which are always under positive pressure to keep dust and abrasives from the movable parts.

OBJECTS OF THE INVENTION

A principal object of the invention is to provide a novel automatic reciprocator device.

Another object of the invention is to provide a simple attachment for automatically reciprocating a movable work table.

BRIEF DESCRIPTION OF THE DRAWINGS

These and other objects and advantages of the invention will be apparent upon reading the following description in conjunction with the drawings, in which.

DESCRIPTION OF THE PREFERRED EMBODIMENT

Figure 1:
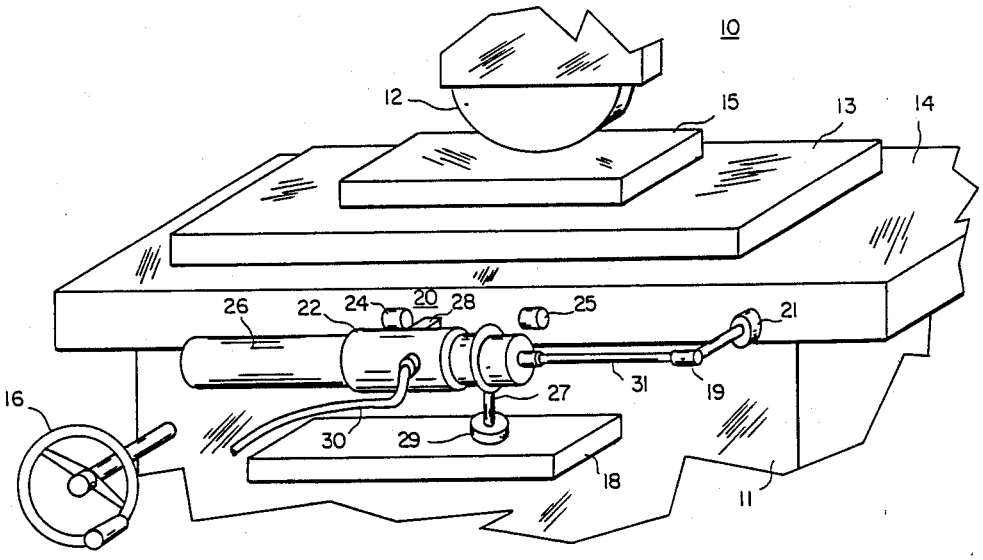
FIG. 1 represents a partial pictorial view of the automatic reciprocator of the invention coupled to the movable table of a surface grinder.

Referring to FIG. 1, a surface grinder 10 of conventional construction includes a base 11, a vertically movable rotating grinding wheel 12 and a magnetic chuck 13 that is affixed to a movable table 14 for securing a workpiece 15 to the table 14 and moving the workpiece 15 with respect to grinding wheel 12. A disconnectable crank 16 is provided to enable a machinist to control reciprocating movement of movable table 14 (in the direction indicated by the double headed straight arrows). The surface grinder thus far described is entirely conventional and well known in the art and requires a great deal of physical effort on the part of a machinist in cranking crank 16 to move table 14 back and forth during surface grinding.

An automatic reciprocator 20, constructed in accordance with the invention, includes a movable sleeve valve 22, including an extension or dog 28 that is engageable by a pair of adjustable stops 24 and 25 carried by the movable table 14. A cylindrical manifold 26 is concentrically mounted with respect to sleeve valve 22 and is attached to a ledge 18 on the base to maintain it in fixed relationship to base 11 of surface grinder 10. Manifold 26 is supported in a ring-type mount 27 that, in turn, is supported on a pedestal 29 that is mounted to ledge 18. Compressed air is supplied to sleeve valve 22 by means of an air line 30. A piston rod 31 is coupled via suitable fittings 19 and 21 to movable table 14 in a rigid manner. While not illustrated in the figures, stops 24 and 25 and attachment 21 are adjustable with respect to movable table 14. The position of attachment 21 is generally not changed after installation of the automatic reciprocator, whereas stops 24 and 25 may be moved quite often, both with respect to each other and with respect to movable table 14, in accordance with the size of workpiece 15. For example, a longer workpiece will necessitate a longer table stroke. In practice a pair of boots are used to keep dust and abrasives out of the reciprocator mechanism. These are omitted for clarity in FIGS. 1 and 2, but are illustrated to FIG. 3.

Figure 3:
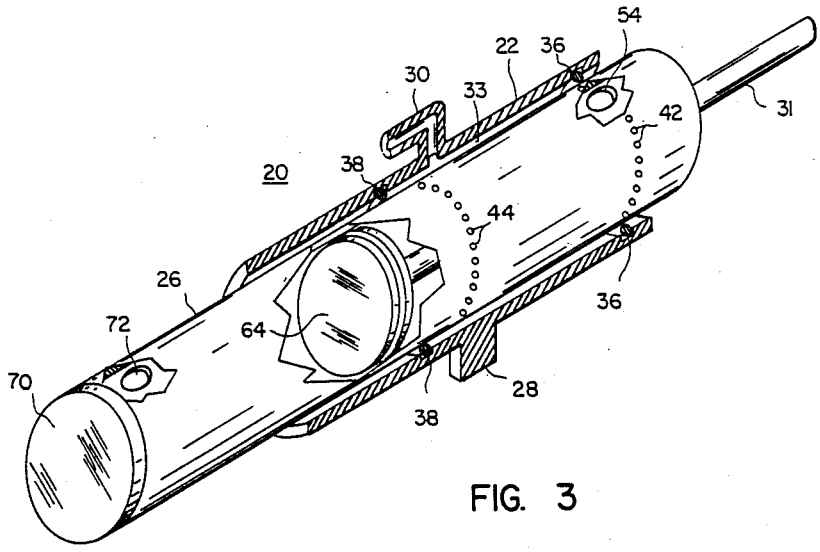
FIG. 3 is a simplified partially broken away perspective view of the automatic reciprocator of the invention.
Figure 2:
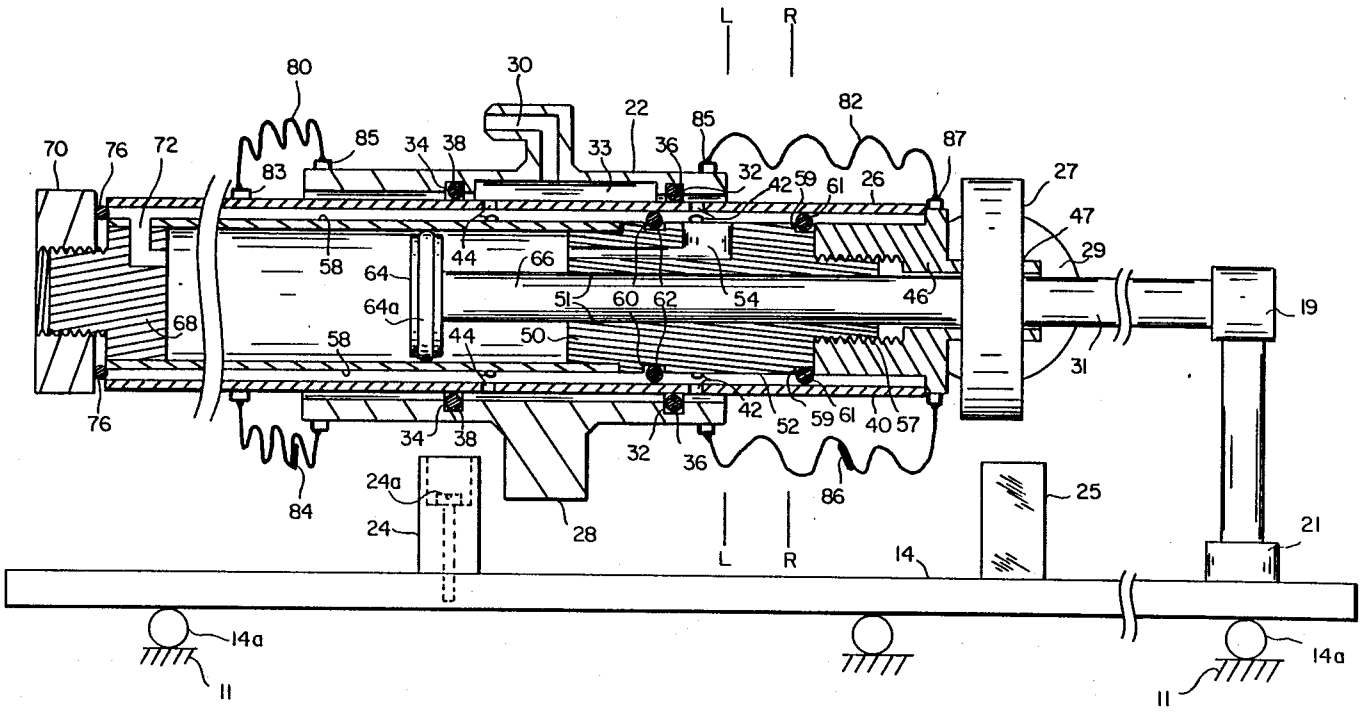
FIG. 2 is an enlarged cross sectional view of the automatic reciprocator of the invention.

Reference to FIGS. 2 and 3 together may be helpful in understanding the construction and operation of the inventive arrangement. Sleeve valve 22 is generally cylindrical and includes a pair of annular grooves 32 and 34 in which resilient annular seals, such as O rings 36 and 38, are captivated. O rings 36 and 38 ride upon the outer surface of cylindrical manifold 26, which includes two circumferential sets of spaced apart air holes 42 and 44. As will be seen, during operation, sleeve valve 22 is moved over the surface of manifold 26, and O rings 36 and 38 ride over air holes 42 and 44, respectively. The O rings are made of a high durometer material and the air holes are made sufficiently small to preclude extrusion of the O ring material therein. A large number of air holes is used to accommodate the air flow requirements of the air cylinder. Also, line lubrication is provided, although not illustrated.

The air cylinder is an off-the-shelf assembly of conventional construction that is modified slightly. It consists of a cylindrical housing 58 having an end closure piece 68 with a threaded extension 69 at one end and a bearing piece 50, having an internal cylindrical bearing surface 51 and a threaded end 57, at the other end. Airways 54 and 72 are provided in bearing piece 50 and end closure piece 68, respectively. A piston 64 including an O ring seal 64*a* is coupled to piston rod 31. Piston rod 31 is movable in bearing surface 51 of bearing piece 50. Thus, responsive to reciprocating movement of piston 64, piston rod 31 is reciprocated. Those skilled in the art will note that in normal use of the air cylinder, one of the airways 54 and 72 is supplied with compressed air through external valving means (not shown) for causing appropriate movement of piston 64 within cylinder housing 58.

A nut 70 is attached to threaded extension 69 of end closure 68 for positioning and securing manifold 26 concentrically with respect to air cylinder 58. An O ring 76 seals the gap between end closure piece 68 and manifold 26. Similarly, a nose piece 46, having an internally threaded surface 48 for matingly engaging threaded surface 57 on bearing piece 50, supports the other end of manifold 26 to maintain concentricity between manifold 26 and air cylinder 58. Bearing piece 50 is modified to form a pair of circumferential grooves 59 and 60 therein on opposite sides of airway 54. A pair of O rings 61 and 62 are captivated in grooves 59 and 60, respectively. O rings 61 and 62 provide a seal between the bearing piece 50 and the inner surface of manifold 26. An extension 47 of nose piece 46 passes through, and is supported by, circular mount 27. As best illustrated in FIG. 2, the bearing means 14*a*, which are part of the surface grinder structure, support movable table 14 for reciprocation. Movable stops 24 and 25 are indicated in schematic form in FIG. 2 to illustrate their relationship to dog 28 on movable spool valve 22. As indicated by dashed lines 24*a*, a bolt or the like may be provided for removably attaching the stop to the movable table.

A pair of flexible, ribbed or convoluted boots 80 and 82 couple the ends of sleeve valve 22 to manifold 26. The boots are conventional and are clamped as indicated by clamps 83, 85 and 87 or otherwise attached to form a dust seal. Vents 84 and 86 are provided in the boots to permit release of air purged from the cylinders. As will be seen, the boots are always under positive air pressure, and consequently, the reciprocator is self-purging to maintain its internal mechanism free of dust and the like.

In operation, lubricated compressed air via air line 30 enters the body of sleeve valve 22 and fills the space or chamber 33 defined by O rings 36 and 38. The set of circumferentially extending air holes 44 in the surface of manifold 26 is shown in communication with chamber 33 of sleeve valve 22 and air enters through air holes 44 and airway 72 to the left side of piston 64. The other set of circumferentially arranged air holes 42 in manifold 26 is precluded from receiving the compressed air and serves to vent the right side of piston 64 via airway 54. The air pressure on the left side of piston 64 moves the piston to the right and drives table 14 accordingly. Stop 24, which is affixed to table 14, engages dog 28 on sleeve valve 22 and moves sleeve valve 22 to the right along the surface of manifold 26. The limit positions of the sleeve valve movement are indicated by the vertical line segments labelled L and R, respectively. L represents the extreme left position of sleeve valve 22 and R represents its extreme right position. When the sleeve valve reaches the R position, O ring 36 will have passed over and to the right of air holes 42 and O ring 38 will have passed over and to the right of air holes 44. In that position, air holes 44 are exposed to substantially atmospheric pressure and air holes 42 are exposed to the pressure of the compressed air from line 30. The compressed air enters holes 42 in manifold 26 and fills chamber 33 in sleeve valve 22. Chamber 33 is in communication with airway 54 and compressed air is now applied to the right side of piston 64 and the left side of piston 64 is vented to atmosphere. Thus the pneumatic forces cause piston 64 to slow, stop and reverse its direction of movement and force a corresponding reversal of movement of movable table 14. Movement in this reverse direction continues until stop 25 engages dog 28 and moves sleeve valve 22 from its R position back to its L position, which again causes a reversal of the compressed air flow, with respect to the piston 64, and the process repeats.

Figure 4A:
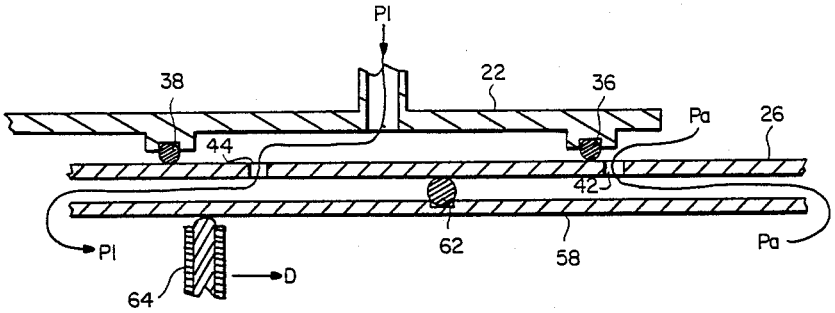
FIGS. 4A, 4B and 4C illustrate the pneumatic cushioning action of the inventive arrangement.
Figure 4B:
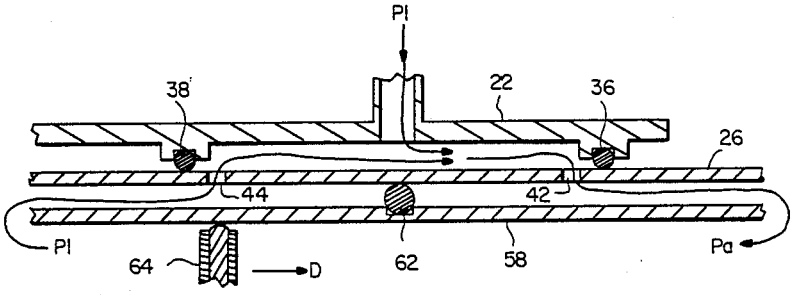
Figure 4C:
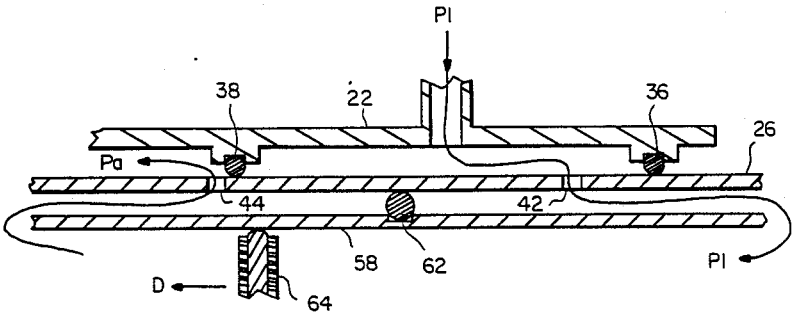

Reference to FIGS. 4A, 4B and 4C will illustrate a further important aspect of the invention. It will be readily appreciated that the movable table 14 of a professional surface grinder is quite massive and, consequently, has a great deal of momentum when it is being reciprocated. The invention provides pneumatic braking or cushioning due to the space relationship between the O rings 36 and 38 carried by the sleeve valve 22 and the sets of air holes 42 and 44 in manifold 26. In FIG. 4A, inlet air at pressure Pl flows to the left side of piston 64 through the illustrated one of air holes 44 while air from the right of the piston is expelled through air hole 42. This expelled air is at a pressure Pa, which is much less than Pl.

In FIG. 4B, sleeve valve 22 has been driven farther to the right. Because the distance between O rings 36 and 38 is greater than that between the two sets of air holes 42 and 44 on the manifold, both sets of air holes are exposed to Pl. Indeed Pl experiences a drop in pressure since air holes 42 open a chamber that is at much lower pressure (Pa). Also, the high pressure air on the left side of piston 64 is not immediately vented to atmosphere, but helps supply 'braking' or cushioning air to the right side of piston 64. For the brief period when the sleeve valve is in the position illustrated in FIG. 4B, the momentum of the table is being rapidly, but controllably reduced.

FIG. 4C shows the table 14 travelling in the other direction with Pl applied to the right side of piston 64 and Pa being on the left. The total effect is that noise is greatly reduced since venting of the air occurs at a lower pressure than Pl and the table is stopped and reversed in a smoother, more controlled manner.

For comparison purposes, the distance between O rings 36 and 38 is about three inches on the reciprocator of the invention to permit pneumatic control movement of the surface grinder table. The large spacing is used to permit significant overtravel of the massive grinder table which is being braked by a compressible medium. The additional benefits of the inventive structure are low noise, controlled table reversal and relatively uncritical tolerances. Obviously other uses may require a greater or lesser spacing for optimum performance.

While the invention has been described in conjunction with a surface grinder application, it will be appreciated that the use of the novel automatic reciprocator is not restricted to that application. Indeed, it is contemplated that the inventive construction will find application in many other environments, such as for spray heads, non-sequenced printing, etc. where an automatic, pneumatically operated reciprocator is desired. Accordingly, the invention is to be limited only as defined in the claims.

What is claimed is:

1. A pneumatic reciprocator comprising:

an air cylinder including a movable piston assembly and air passageways;

manifold means substantially surrounding said air cylinder and isolating said air passageways; and sleeve valve means movably mounted on said manifold means for supplying compressed air to said air passageways in accordance with the position of said sleeve valve means on said manifold means.

2. The reciprocator of claim 1 wherein said movable sleeve valve means and said manifold means are cylindrical in shape and are concentrically positioned with respect to each other by a pair of resilient annular seals.

3. The reciprocator of claim 2, further including two sets of circumferentially arranged air holes in said manifold means cooperating with said resilient annular seals for pressurizing one side of said piston assembly and venting the opposite side of said piston assembly.

4. The reciprocator of claim 3 wherein said cylindrical sleeve valve means includes an undercut portion between said pair of resilient annular seals for increasing the volume of compressed air available to said air holes in said manifold means.

5. The reciprocator of claim 4 wherein said pair of resilient annular seals are spaced apart by a distance that is greater than the distance between said sets of circumferentially arranged air holes.

6. The reciprocator of claim 5, further comprising boot means, including vent means, coupled between said sleeve valve means and said manifold means, said boot means always being under positive pressure.

7. A pneumatic reciprocator comprising:

a cylindrical air cylinder including a movable piston assembly and air passageways;

cylindrical manifold means substantially surrounding said air cylinder and isolating said air passageways;

cylindrical sleeve valve means including spaced apart resilient annular seal means engaging said manifold means, said sleeve valve means being movable back and forth along said manifold means for supplying compressed air to said air cylinder via said air passageways; and two sets of circumferentially arranged and spaced apart air holes in said manifold means in respective communication with said air passageways.

8. The reciprocator of claim 7 wherein the distance between said resilient annular seals is greater than the distance between said two sets of air holes.

9. The reciprocator of claim 8 wherein said resilient annular seals are 'O' rings of high durometer and wherein said holes are sufficiently small to minimize extrusion into said air holes.

10. The reciprocator of claim 9 wherein the distance between said 'O' rings is approximately three inches.

11. The reciprocator of claim 10, further comprising boot means, including vent means, coupled between said sleeve valve means and said manifold means, said boot means always being under positive pressure.

* * * * *